United States Patent [19]

Seffernick et al.

[11] Patent Number: 4,543,714

[45] Date of Patent: Oct. 1, 1985

[54] MACHINE INSERTION OF CIRCUIT MODULE TERMINALS

[75] Inventors: Lewis L. Seffernick, Decatur; Gary W. Trobridge, Portland, both of Ind.

[73] Assignee: CTS Corporation, Elkhart, Ind.

[21] Appl. No.: 420,714

[22] Filed: Sep. 21, 1982

[51] Int. Cl.[4] ..... H05K 3/00; B23P 19/00

[52] U.S. Cl. ..... 29/845; 29/564.6; 29/739; 227/97

[58] Field of Search ..... 29/739, 845, 882, 884, 29/564.1, 564.2, 707, 564.6, 747, 798; 227/95, 97; 361/400; 174/52 FP; 339/17 C

[56] References Cited

U.S. PATENT DOCUMENTS

| | | | |
|---|---|---|---|
| 2,970,370 | 2/1961 | Weaver et al. | 227/95 |
| 3,346,774 | 10/1967 | Brady | 361/400 |
| 3,492,536 | 1/1970 | Girolamo et al. | 174/52 FP |
| 3,524,108 | 8/1970 | English | 339/17 C |
| 3,550,250 | 12/1970 | Cervenka et al. | 29/564.6 X |
| 3,574,935 | 11/1968 | Berg | 29/739 X |
| 4,365,398 | 12/1982 | Chisholm | 29/739 X |

*Primary Examiner*—Howard N. Goldberg
*Assistant Examiner*—Carl J. Arbes
*Attorney, Agent, or Firm*—Rodger H. Flagg

[57] ABSTRACT

An apparatus (10) and method for the automatic insertion of terminals (84) into cavities (16) of a ceramic substrate (15). A continuous carrier web (80) is advanced from a reel (90), into an automatic terminal insertion apparatus (10) simultaneously with the automatic advancement of substrates (15) along a trackway (20). As a substrate (15) is secured by a securement and lateral transmission apparatus (170) and moved laterally from the trackway (20) to align the substrate cavities (16) with associated transmittal barrels (162), a web hold down apparatus (130) secures web portion (82) of carrier web (80) and the cut-off blade (146) of a separation block (144) moves downwardly to separate a predetermined number of terminals (84) from the web portion (82) and locate the terminals in transmittal slots (152) located in a subjacent pressure pad (150). The separation block (144) and subjacent pressure pad (150) enclose the separated terminals (84) in transmittal slots (152) and move downwardly together to align the transmittal slots (152) with transmittal barrels (162). Compressed air is injected into the slots (152) and propels the terminals (84) through the slots (152) and aligned transmittal barrels (162) into the respective substrate cavities (16). The severed end of each terminal (84) bites into the respective cavity walls to securely anchor the terminals (84) in the substrate cavities (16), all without any swaging, scratching, marring, or damage to the exterior portions of the terminals. The exterior portion of each terminal is undamaged, has no cut marks, and plated terminals retain their protection against corrosion.

38 Claims, 17 Drawing Figures

MACHINE INSERTION OF CIRCUIT MODULE TERMINALS

TECHNICAL FIELD

The method and apparatus for the insertion of circuit module terminals relates to the production of miniature resistor networks for use in the electronics industry.

BACKGROUND ART

Miniature resistor networks (also known as circuit modules) are utilized in many electronics applications such as computers and other business equipment. The circuit modules may consist of a ceramic substrate having a plurality of resistors and conductive paths on one or both surfaces and connected to terminals secured to the substrate. The terminals may consist of a variety of metallic conductors attached by various methods to the substrate.

Cermet resistor networks are illustrated in the advertising brochures of resistor network manufacturers, such as the CTS Corporation Cermet Resistor Network Catalog 3755B. CTS Catalog 3755B illustrates a variety of resistor network configurations generally comprising alumina substrates having a plurality of terminals inserted in associated apertures disposed in an end of the alumina substrate. The terminals may be either round wires having an end force fitted into a noncomplementary shaped cavity in the substrate, or flat wires having an end force fitted into associated noncomplementary shaped openings and subsequently trimmed to shape. After insertion, the terminals are wave soldered to insure their electrical connection with conductive material disposed about and in the apertures into which the terminals are secured, and to provide corrosion protection for the portions of the terminals extending exteriorly of the alumina substrate. A resistor network having terminals attached and secured thereto by this method and the terminals coated by wave soldering, may be mounted onto a PC board having a plurality of holes for receiving the respective terminals, the terminals then connected to the PC board by wave soldering. The manner in which the terminals are anchored in the cavities in the end of the substrate, is described in commonly-owned U.S. Pat. Nos. 3,280,378 entitled "Means for Anchoring and Connecting Lead Wires and an Electrical Component," issued Oct. 18, 1966, and U.S. Pat. No. 3,346,774 entitled "Electrical Component Substrate with Cavities for Anchoring Lead Wires Therein," issued Oct. 10, 1967.

The prior art method for mechanically securing and anchoring terminals in the alumina substrate is schematically illustrated in FIGS. 1A and 1B. It comprises a method wherein a plurality of wires 1 are fed by gripping device 8 from reels 9 through a complementary group of open ended barrels 2 and into transmittal slots 5 (see FIG. 1A), the number of wires, barrels, and slots matching the number of associated cavities 6 in the end of the alumina substrate 7. A cut-off or blade device 3 moves downwardly to cut the wires to proper length, and while the cut-off device is extended and covers the back of the slots 5 (see FIG. 1B), compressed air is fed through a manifold 4 in the cut-off device and into the rear of each transmittal slot 5 so that the terminals are blown by compressed air through the slots and into the associated cavities 6 of the substrate 7 positioned adjacent the end of the slots 5. The blade device 3 and subjacent barrels 2 retract upwardly, the wires are advanced by gripping device 8, and the other steps repeated.

This prior art method has proved successful for the manufacture of resistor networks wherein the cut end of each terminal deforms and bites into the substrate cavity to securely anchor the terminal. A problem posed by this method is that both ends of the terminal have been cut by the blade device, i.e. after the cut and blow-in insertion, the blade device rises, the wires are advanced an appropriate length, the blade decends to cut the terminals to length, and then the terminals are blown into a substrate. Because the ends of the terminals exterior to the substrate have been cut, the exterior ends (although suitable for insertion into corresponding openings in a PC board) can cut or gouge metallic sockets into which the terminals might be inserted. Likewise, if the terminals are of a flat configuration as illustrated in Catalog 3755B, the cut exterior end of each terminal produces a nonuniform shaped, deformed end which can damage a socket into which the terminal is inserted, and therefore the cut exterior portions of the terminals are not suitable for use with a pluggable component such as a socket assembly. Additionally, solder coating the terminals will not satisfactorily protect the terminal from corrosion to provide a long wear life covering decades of years.

The problems facing the industry are how to provide a resistor network having a plurality of terminals anchored in the substrate whereby by the exterior ends of the terminals are uniformly shaped, such that there are no deformation marks, swaging, or irregularities which can cut into and damage a metallic socket when the terminals of the resistor network are inserted, and also how to increase the integrity and reliability of a protectively plated terminal so that the resistor network has a wear life and superior electrical conductivity for decades. Thus, there is needed for securement in a substrate both a plated terminal that will provide long term resistance to corrosion and superior electrical conductivity, plus a terminal whose exterior has not been deformed, cut, scratched, or swaged before, during, or after the process of inserting and anchoring the terminal in the substrate, and thereby may be utilized with a pluggable component so that the circuit module can be readily removed from the PC board as desired.

DISCLOSURE OF THE INVENTION

The present invention comprises an apparatus and method for terminal insertion wherein a plurality of ceramic substrates having both conductive and resistive materials fired thereon, are automatically aligned and advanced into a trackway which receives the serially aligned substrates and guides them downwardly by means of gravity through a testing station where the individual resistors of a resistor network are tested. Resistor networks not meeting quality specifications are automatically ejected from the trackway after testing, while those meeting quality standards are allowed to move along the trackway. The serially aligned substrates are moved forward individually by a substrate advance apparatus that advances the substrates into a terminal insertion assembly. Concurrent with the automatic feed of tested substrates into the terminal insertion assembly, is the automatic advance of a continuous carrier web by a carrier web advance apparatus including an automatic unwinding reel supporting the carrier web. The carrier web comprises a carrier portion having a plurality of regularly spaced terminals projecting from one side thereof. The web advance apparatus automatically grips the carrier portion of the web and moves the carrier web forward a predetermined distance into the terminal insertion assembly so that a set of terminals are moved into operative position for insertion into an associated substrate advanced into insertion position. The associated substrate has been moved both forwardly along the trackway and laterally from the trackway to be positioned opposite a series of terminal transmittal barrels in the terminal insertion assembly.

The terminal insertion assembly includes an air cylinder powered apparatus moving a pilot and hold down fixture downwardly to trap the carrier web and secure the carrier portion in place. Coordinated with this hold-down movement is the operation of a separation apparatus also powered by an air cylinder that moves the cut-off blade of a separation block downwardly and perpendicularly to the plane of the carrier web, the separation apparatus separating the set of terminals from the carrier portion of the carrier web.

Located subjacent to the separation apparatus, is a pressure pad having a plurality of longitudinal slots positioned for receiving the separated terminals. The separated terminals are deposited and then trapped within the pressure pad slots by the overlying separation block pressing against the top surface of the pressure pad. The separation block and pressure pad move downwardly to a lower level where the slots in the pressure pad are aligned with associated transmittal barrels for receiving the separated terminals.

Simultaneous with the separation and positioning of the terminals in the longitudinal slots of the pressure pad, the associated substrate in the trackway has been advanced by a lateral transmission assembly which moves the substrate laterally from the trackway to a position adjacent the end of the transmittal barrels. Located linearly at the opposite end of the transmittal slots and adjacent the pressure pad, is a compressed air input line and valve. While the plurality of terminals are being separated and trapped within the longitudinal slots of the pressure pad by the overlying separation apparatus and the joint assembly of the separation apparatus and pressure pad moving downwardly so that the transmittal slots and barrels align, the associated substrate is positioned in alignment by the lateral transmission assembly. The valve opens to feed compressed air into the transmittal slots and propel the terminals through the transmittal slots and barrels such that the cut end of each of the terminals is force fitted and anchored into an associated substrate cavity.

After the terminals have been anchored in the associated substrate cavities, the lateral transmission assembly returns the substrate to the trackway, the substrate is released by the transmission assembly, and the entire terminal insertion apparatus operates through another cycle wherein a successive substrate is advanced along the trackway which in turn advances the previously assembled substrates with anchored terminals. Concurrently, the carrier web is released by the pilot and hold down device, and the web is automatically advanced so that another set of terminals are positioned for separation from the web.

The substrate with anchored terminals advances down an ejection track which twists in order to orient the ceramic substrate in a vertical plane. The assembled substrates having terminals secured therein advance along the ejection trackway by means of vibration imparted by a vibratory mechanism. At the end of the trackway, the substrate enters a magazine loading assembly which moves the substrate laterally off the trackway and into a holding tube.

The method and apparatus of the present invention accomplishes two major improvements in the manufacture of resistor networks. First, the terminals inserted into the cavities of the associated substrate, have only one end of the terminal cut and that cut end is force fitted and anchored into the respective cavity. The exterior end of the terminal has not been cut and retains its symetrical preformed shape, be it a round terminal, flat terminal, or cylindrically shaped terminal. If the terminals are unplated terminals, then the terminals may be protectively coated against the effects of corrosion by the wave soldering process, and flat terminals no longer need to be trimmed to shape by later forming operations because the terminals have been preformed as part of the carrier web. The resistor network is suitable for machine insertion of the terminals into PC board openings or into metallic sockets without risk of the metallic sockets being damaged by a deformed or cut terminal end biting into and gouging the socket.

Second, the method and apparatus are utilized for the insertion of selectively plated terminals, and thus terminals that have been plated in order to maintain electrical conductivity and protection against corrosion, will not be scratched, damaged, swaged, or deformed during insertion into the substrate cavities. The selectively plated terminals anchored in the substrate, whether round terminals or flat terminals, are connected to the circuitry on the substrate by a selective solder deposition and reflow process wherein solder is applied at the junction of each terminal with the conductive notch area of the substrate, and then the substrate is heated to effect a reflow of the solder and enhance the electrical and mechanical connection of the terminal with the conductive notch area. The plating remains intact and the wear life of the resistor module, and most importantly its reliability, are greatly increased many years beyond the reliability and wear life of resistor networks produced by prior art methods. Additionally, the plating of the terminal increases the electrical conductivity of the individual terminals by lowering contact resistance, and, of course, protects the terminal from corrosion which also adversely affects contact resistance. The uniformly shaped ends of the plated terminals do not bite into, scratch, or deform the plated socket, and thus additional electrical conductivity reliability and protection from corrosion is accomplished. Thus, resistor modules constructed in accordance with the present invention are suitable for use with a pluggable component so that the resistor module may be removed at a later time and then reinserted.

BEST MODE FOR CARRYING OUT THE INVENTION

Figure 1A:
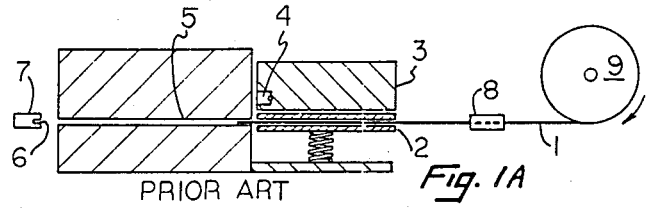
PRIOR ART Fig. 1A
FIG. 1A is a schematic representation of a prior art terminal insertion apparatus.
Figure 1B:
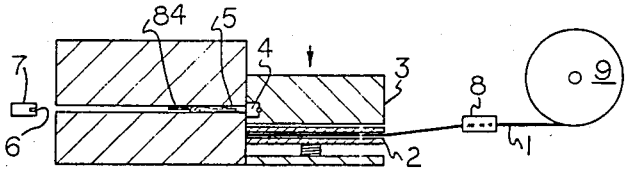
PRIOR ART Fig. 1B
FIG. 1B is a schematic representation of the prior art terminal insertion apparatus of FIG. 1A, and illustrates the cutting block at the bottom of its stroke and the terminals being propelled toward the cavities of the substrate.
Figure 2:
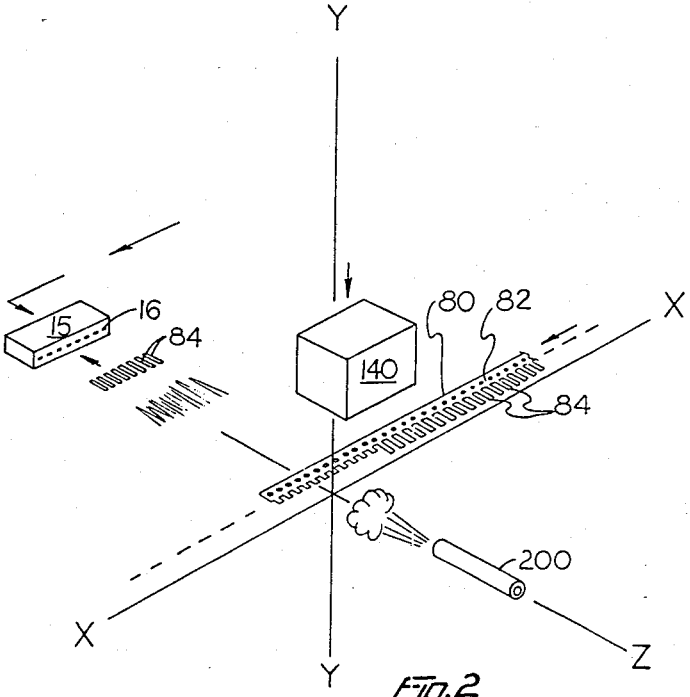
FIG. 2 is a three dimensional schematic representation of the terminal insertion method of the present invention.

FIG. 2 is a three dimensional schematic representation of the method and apparatus of the present invention. The method of terminal insertion comprises the separate dimensional movements of the carrier web 80, the separation apparatus 140, and the blow-in insertion of the separated terminals 84. The carrier web 80 is periodically advanced in stepwise manner parallel to the X axis, in conjunction with the timed movements of the separation apparatus 140 which moves downwardly to separate a set of terminals 84 from the carrier portion 82 of web 80. Separation apparatus 140 moves along the Y axis perpendicularly to the movement of the carrier web. The terminals 84 that have been separated from the carrier portion 82, are aligned with the Z axis and subjected to a blast of compressed air emitted from compressed air feed apparatus 200, which propels the separated terminals along the Z axis toward the substrate 15 positioned for reception of the separated terminals 84 in their associated substrate cavities 16. The substrate follows a path of advancement parallel to the advancement of the carrier web 80, that is along a path parallel to the X axis, and then is moved laterally along the Z axis to position the substrate 15 and associated cavity 16 for reception of the separated terminals 84. After insertion of the terminals 84 into the associated cavities 16, the substrate 15 is returned laterally along the Z axis to its original position on the trackway, and then moved along a path parallel to the X axis so that another substrate 15 may be positioned for terminal insertion.

Figure 3:
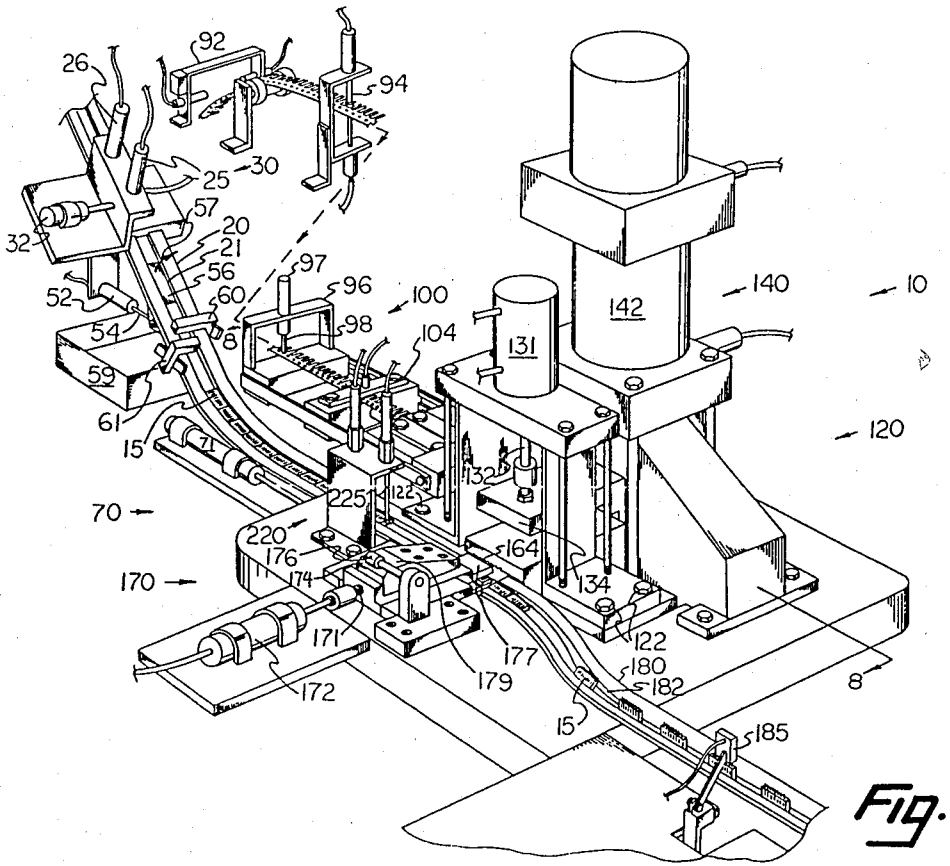
FIG. 3 is an isometric view of a schematic representation of the terminal insertion apparatus.
Figure 4:
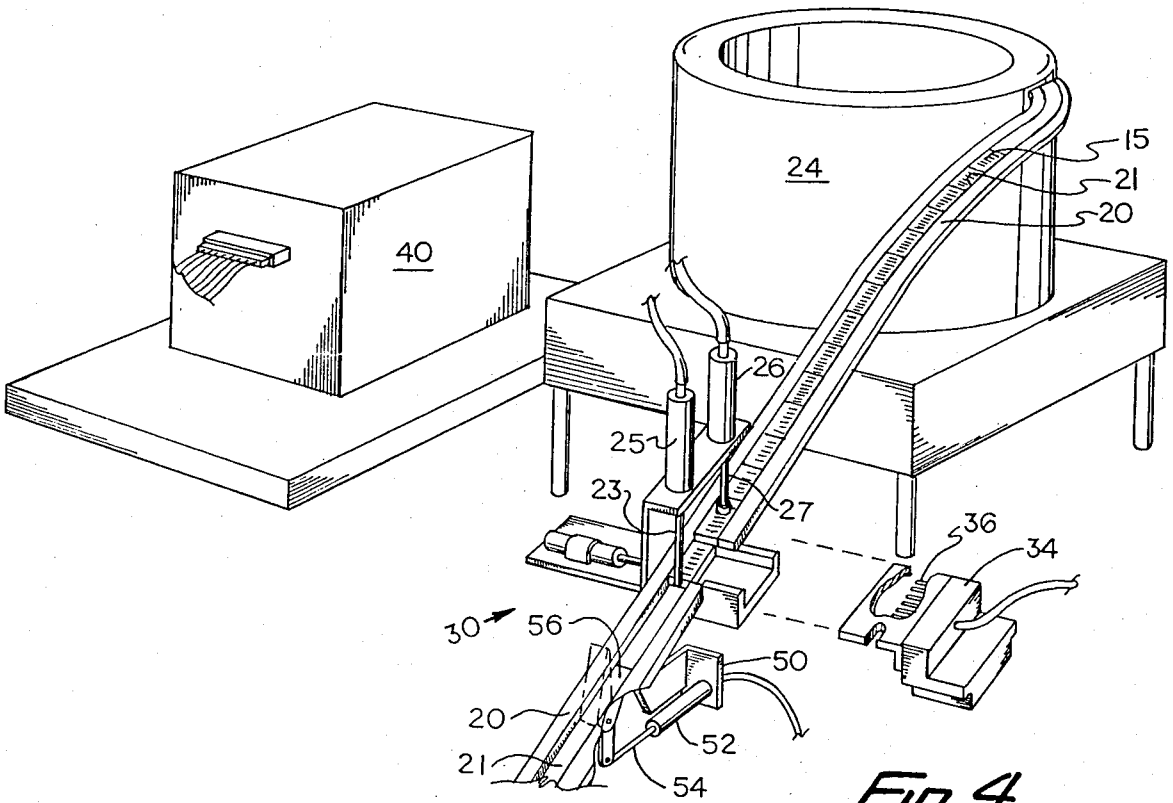
FIG. 4 is an isometric view of the bowl feeder, trackway, testing station, and test computer.

Referring to FIGS. 3 and 4, the terminal insertion apparatus is designated generally by reference numeral 10. Substrates 15 are fired alumina substrates with cavities 16 and a conductive and resistive network screen printed thereon and fired (see FIG. 12). The substrates 15 are automatically oriented and fed into the trackway 20 by a bowl feeder 24 such as one manufactured by Hendricks Engineering, Inc. of Indianapolis, Ind. Trackway 20 having chute 21 is positioned in angled vertical alignment in order to utilize gravity to advance a plurality of substrates 15 along the trackway 20.

Figure 4A:
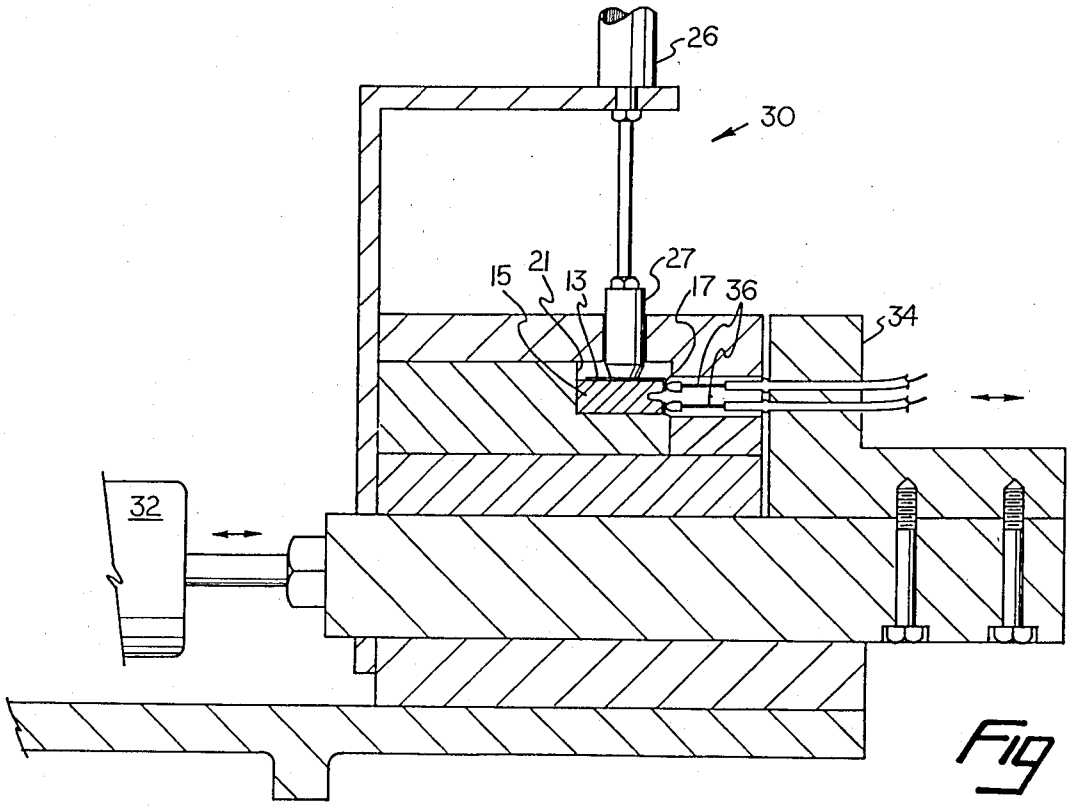
FIG. 4A is a section view of the circled area of FIG. 4.

The substrates 15 are held in position at the testing station designated generally by reference numeral 30. As the substrates 15 advance by gravity through chute 21 of trackway 20, they are in serial alignment and are stopped and held by compressed air operated clamps 25, 26 (see FIGS. 4 and 4A). Clamp 25 moves rod 23 downwardly to block chute 21 so that the lead substrate 15 abuts against the rod 23. Hold down pad 27 of clamp 26 secures in place the next substrate following and abutting against the lead substrate. The clamps 25, 26 operate sequentially so that after the testing of the resistor circuit on the lead substrate, clamp 25 retracts rod 23 and the lead substrate advances down chute 21 while clamp 26 retains the next substrate in position along with the serially aligned and abutting substrates. Clamp 25 then moves rod 23 downwardly into blocking position within the chute 21, and clamp 26 releases the next substrate and serially aligned substrates so that they move forward and the next substrate abuts against the rod 23. Clamp 26 moves pad 27 downwardly to secure the succeeding aligned substrate, and the testing procedure is repeated.

Testing station 30 tests each of the individual resistors in a resistor network to determine whether or not they meet quality standards. The clamp 25 holds a substrate 15 in position within chute 21 as probe assembly 34 transported by air cylinder 32 is moved into testing position. The air cylinder 32 is a Tom Thumb air cylinder ("DAV" series) which can be obtained from PHD, Inc., Box 9070, Fort Wayne, Ind. Many types of air cylinders may be utilized, and these are submitted as only illustrative of the general type of air cylinders that can be utilized with the present invention. Air cylinder 32 is activated by a computer 40 and moves the probe assembly 34 laterally relative to the trackway 20 so that pairs of contact probes 36 engage associated conductive pads or notches 17 (see FIG. 12) located on the end of the substrate. Each resistor 13 on the surface of substrate 15 is connected to a conductive pathway 12 that terminates in a conductive pad 17 on the end of the substrate, and the pairs of contact probes engage the respective conductive pads. Computer 40 automatically tests the individual resistors, and after completion of the test, air cylinder 32 returns laterally the probe assembly 34 so that contact probes 36 disengage the respective conductive pads 17. If the resistors of the network have met quality standards, the substrate is released by clamp 26 and allowed to progress, by gravity feed, through chute 21.

Figure 5:
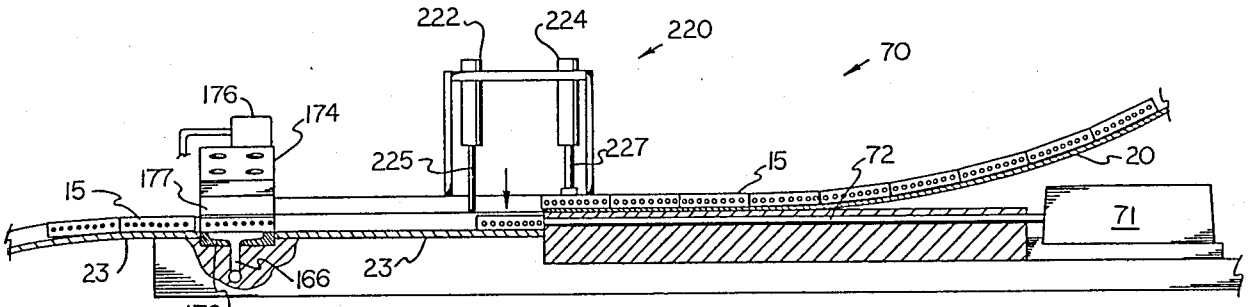
FIG. 5 is a section view of the substrate advancement apparatus and taken along view line 5—5 of FIG. 10.
Figure 8:
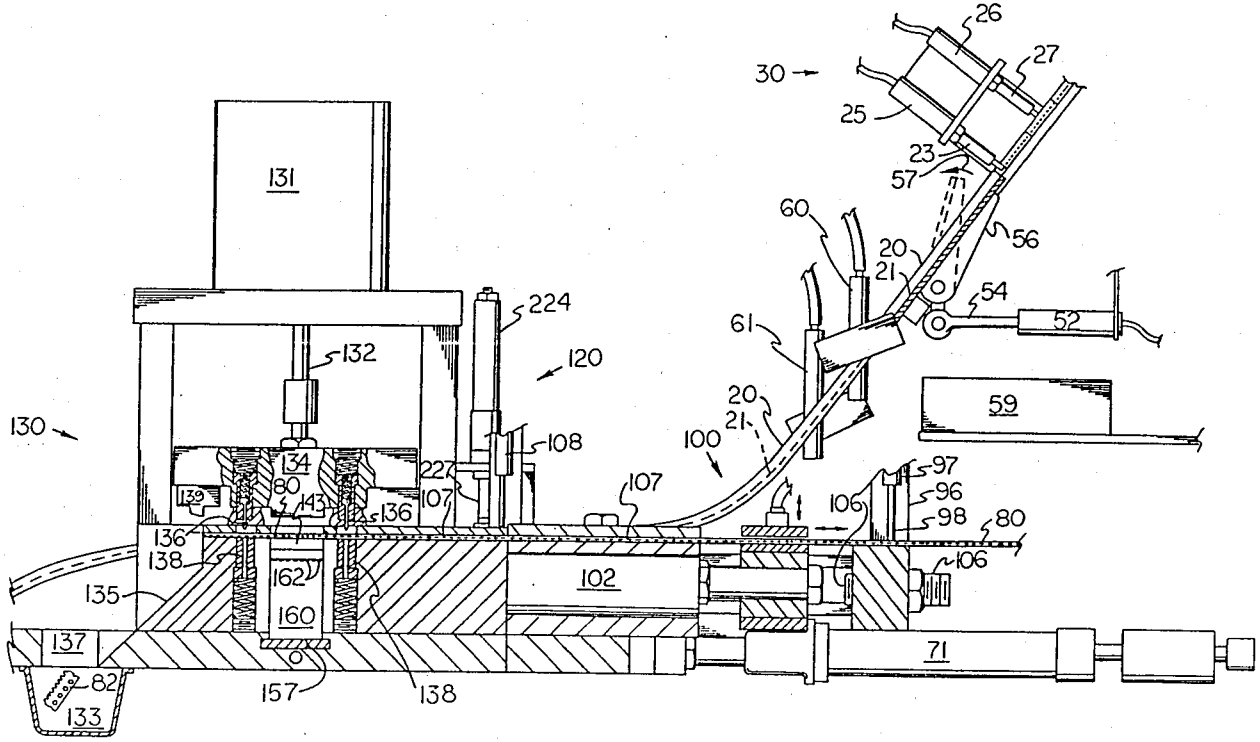
FIG. 8 is a section view along line 8—8 of FIG. 3 and illustrates the web advancement apparatus and its relationship to the terminal insertion apparatus.

The resistor networks that do not meet quality standards are ejected automatically from trackway 20 by a track ejector 50, illustrated in FIGS. 3, 5, and 8. The computer 40 automatically activates a Tom Thumb air cylinder 52, ("AV" series), which retracts connecting rod 54 to pivot the ejection door 56 upwardly in the direction of arrow 57 (see FIG. 8). The resistor network that has failed to meet quality standards, is released by clamp 25, slides down trackway 20, contacts ejection door 56, and falls into dump box 59. If the resistor network met quality standards, then the substrate progresses down the trackway 20 and the track ejector apparatus 50 is not activated by computer 40.

Photoelectric switches 60 and 61 (see FIGS. 3 and 8) are positioned along trackway 20 to detect substrates progressing through chute 21. Switch 61 provides a means for insuring that there are sufficient substrates in the chute 21 for the proper gravity feed of substrates to the terminal insertion apparatus 10, and switch 60 provides a back-up detector which shuts down the testing station 30 if there is a backlog of substrates in chute 21.

Figure 10:
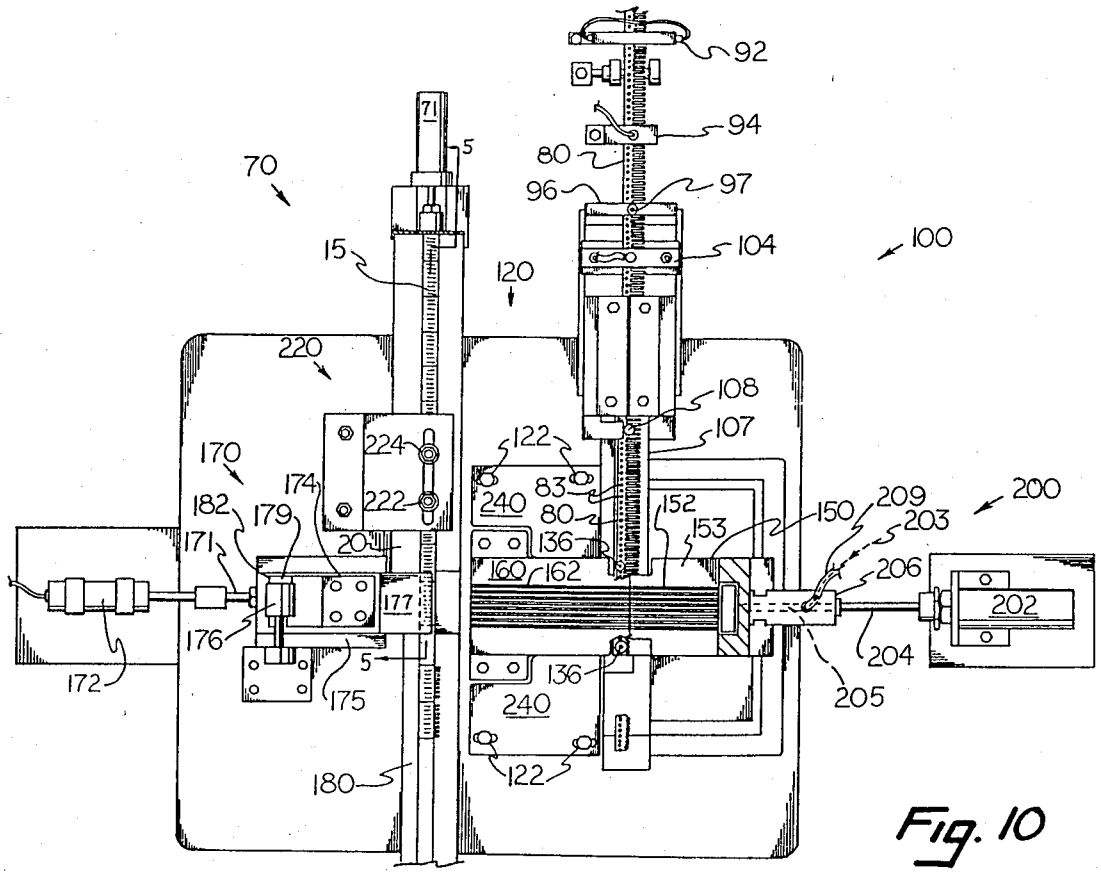
FIG. 10 is a top section view along line 10—10 of FIG. 9.

Substrates 15 progress down the trackway until each abuts against the preceding substrate awaiting automatic feed into insertion assembly 120 by the substrate advance apparatus designated generally by reference numeral 70 (see FIGS. 3, 5 and 10). The substrate advance apparatus utilizes a Tom Thumb air cylinder 71 ("DAV" series) to displace plunger 72 which advances individual substrates into terminal insertion assembly 120. Adjacent trackway 20 is escapement mechanism 220 which operates as a part of substrate advancement apparatus 70. The escapement mechanism 220 holds two substrates 15 in position, and thus the subsequent substrates, while the lead substrate 15 is handled for terminal insertion. Escapement mechanisms cylinder 222 and 224 operate in sequential operation much the same as clamps 25 and 26. Cylinder 222 moves rod 225 (FIG. 3) downwardly and the lead substrate 15 abuts against it, and cylinder 224 moves hold down pad 227 (FIG. 5) downwardly to clamp and hold the next to the end substrate 15 in place, thereby stopping and holding in place the serially aligned substrates abutting one against the other in chute 21. In timed sequence, the plunger 72 is retracted by its air cylinder 71, and the lead substrate 15 which was supported in chute 21 by the top surface of the plunger 72, falls downwardly into the subjacent level 23 of the chute 21 and cylinder 222 moves rod 225 upwardly. Plunger 72 advances on its return stroke and pushes the lead substrate into terminal insertion position. While the plunger 72 is extended to position the lead substrate in terminal insertion position, the sequentially operated cylinders 222 and 224 operate such that cylinder 222 moves rod 225 downwardly, cylinder 224 retracts hold down pad 227 so that the substrates in the chute move forward and the formerly second-in-line substrate abuts against rod 225 while being supported by the upper surface of plunger 72. Cylinder 224 moves hold down pad 227 downwardly to secure the now second aligned substrate. After the insertion of terminals into the substrate positioned for terminal insertion, the plunger 72 retracts, the substrate abutting rod 225 falls into the subjacent level of the chute, and on the return stroke the plunger pushes the lead substrate forward along the subjacent level 23 so that the assembled substrate having terminals inserted therein is pushed along level 23 into ejection trackway 180.

Concurrent with the automatic testing and movement of substrates along the trackway 20, is the automatic feed of carrier web 80 to the terminal insertion assembly 120.

Figure 6:
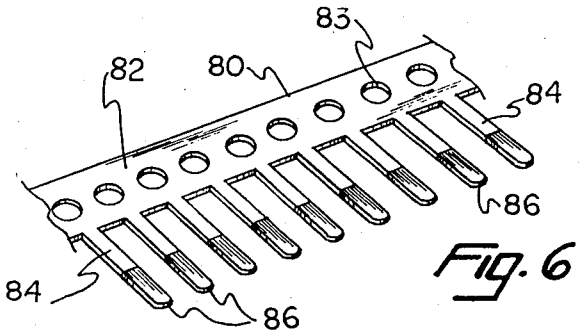
FIG. 6 is an illustration of the carrier web.
Figure 7:
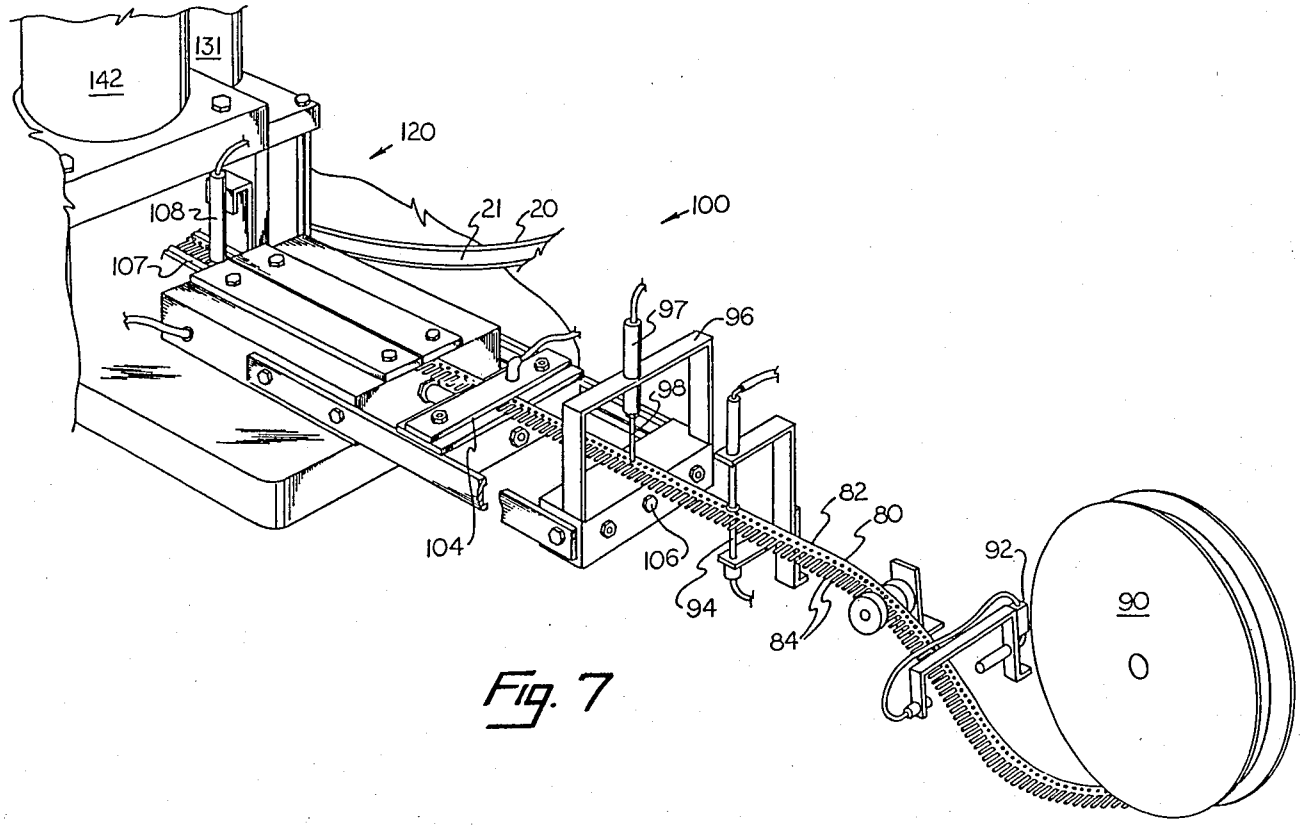
FIG. 7 is an isometric view of the web advance apparatus and associated components.

Carrier web 80, as shown in FIG. 6, is comprised of a carrier portion 82 having web apertures 83 and a plurality of terminals 84 projecting from one side thereof. The terminals 84 are integral with carrier portion 82, may be round or rectangular shaped, and may be unplated or selectively plated depending on the particular resistor module to be constructed. The terminals may be separated from the carrier web by a cutting action or the portions of the terminals adjoining the web may be notched to weaken the connection between each terminal and the carrier portion of the web to permit the terminals to be "broken away" from the web. These various expedients are all contemplated by the present invention.

Plating of the terminals is illustrated by plated portions 86 in FIG. 6. The terminals are plated in order to protect them from the effects of corrosion, and also to lower contact resistance and thus increase the electrical conductivity between the resistor network and the exterior circuit to which the resistor network is connected.

The continuous carrier web 80 is fed from reel 90 (FIG. 7) rotated automatically in conjunction with the automatic feed of the web into web track 107 of terminal insertion assembly 120 (see FIGS. 3, 7, 8 and 10). Slack detector 92 is located adjacent the reel 90 so that when the length of the web shortens, slack detector 92 is tripped which energizes a motor that rotates the reel a predetermined time in order to provide a predetermined length of carrier web 80. The carrier web 80 passes through splice sensor 94 which scans the web for splices, and when a splice is detected, terminal insertion apparatus 10 is shut down in order that the splice may be advanced through the apparatus without causing a jam.

Located next in line after splice sensor 94, is web securement apparatus 96 powered by an air cylinder 97 that moves rod 98 downwardly in timed sequence to secure web 80 in place and keep it from moving backwardly when web grips 104 release the web and move backwardly to regrip the web. Web securement apparatus 96 prevents the web from slipping backwardly and out of lead insertion assembly 120 during the cycling of web grips 104 as described below.

The carrier web 80 enters into a web advance apparatus designated generally be reference numeral 100 (see FIGS. 3, 7, 8, and 10). The web advance apparatus 100 comprises a Rapid-Air press feeder model No. AZ, obtainable from Rapid-Air Corporation, 821 First Street, Madison, S.D., and includes an air cylinder 102 activated periodically so that web 80 is grasped between web grips 104 and advanced a predetermined distance into terminal insertion assembly 120. This predetermined distance corresponds to the number of terminals to be separated from the web and inserted into a substrate 15. The predetermined distance for the advancement of the carrier web is set by adjusting the stroke of the web grips 104, and this is accomplished by adjusting stop 106 which may be moved inwardly or outwardly to vary the point of contact with web grips 104, and thereby adjust the length of carrier web 80 advanced into terminal insertion assembly 120. Thus, the web is advanced a predetermined distance to position terminals 84 for separation from the carrier portion 82 and insertion into their associated cavities 16 (FIG. 12) of a substrate 15.

Located adjacent terminal insertion assembly 120 is web position sensor 108 (see FIGS. 7, 8, and 10) which is a photo-optic scanner that determines if a terminal of carrier web 80 is properly positioned within terminal insertion assembly 120, thereby determining whether or not the web is properly positioned. An alternative method of scanning the carrier web in order to monitor its position in terminal insertion assembly 120, utilizes an optical array sensor having a plurality of lights directed upwardly from the underside of the carrier web such that eight terminals, for an eight terminal insertion process, block the respective light sources. Located above the carrier web is a receiver which senses light intensity, and thus the position of the carrier web 80 can be accurately determined in relation to all eight terminals that are to be separated and inserted into a substrate.

Figure 9:
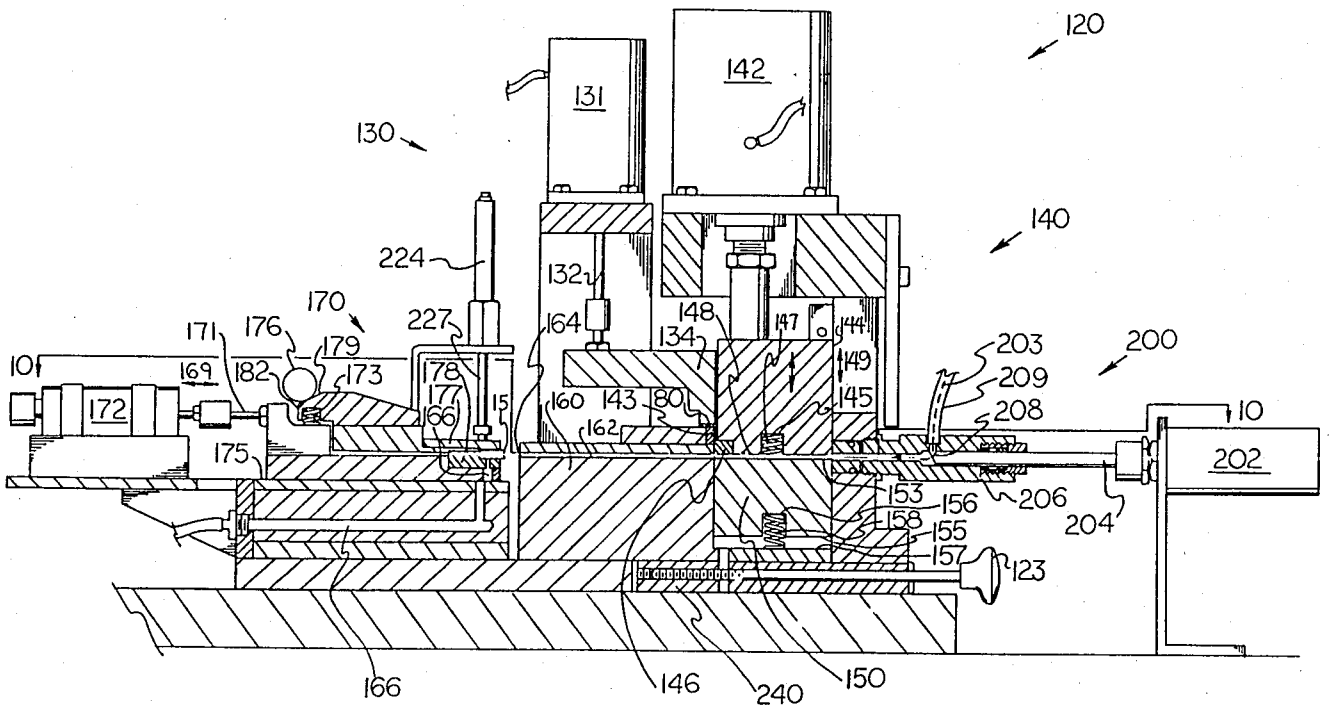
FIG. 9 is a section view along line 9—9 of FIG. 10 and illustrates (in blow-in position) the securement and lateral transmission assembly, the trackway and substrate, transmittal barrels, pressure pad, pressure pad transmittal slots, separation apparatus, pilot and hold down apparatus, air input apparatus, and adjustment features.

Web advance apparatus 100 operates automatically in conjunction with a web hold down apparatus designated generally by reference numeral 130 (see FIGS. 8 and 9). Web hold down apparatus 130 utilizes an air cylinder 131 connected by connector rod 132 to a pilot and hold down clamp 134. Air cylinder 131 is automatically activated to move the pilot and hold down clamp 134 downwardly to position and secure in place the web 80. Pilot and hold down clamp 134 has a pair of interior locater pins 136 (see FIG. 8) which pass through associated carrier web apertures 83 and are received by pin receptors 138 to positively and accurately locate the web in terminal insertion assembly 120. After separation of a set of terminals, air cylinder 131 retracts pilot and hold down clamp 134 so that web 80 may be advanced through web track 107 and a next set of terminals 84 positioned for separation from the web.

Attached to web hold down apparatus 130 is cutting blade 139 (see FIG. 8). Cutting blade 139 moves downwardly with web hold down apparatus 130 so that the carrier portion 82 of carrier web 80 which has had the plurality of terminals 84 separated therefrom, is cut and separated from the carrier web and falls through opening 137 into a scrap box 133. Thus, each time the web hold down apparatus 130 moves downwardly to secure the web within terminal insertion assembly 120, a portion of the carrier web having terminals previously separated therefrom, is cut away, slides down ramp 135, and falls through opening 137 to the scrap box 133.

Referring now to FIGS. 9 and 10, located adjacent the pilot and hold down clamp 134, is separation apparatus 140. FIG. 9 illustrates the terminal insertion assembly 120 having its subassemblies and components in alignment for propulsion of the separated terminals. Separation apparatus 140 includes a Hydro-Line air cylinder 142, model No. R2FD, which may be obtained from Hydro-Line Manufacturing Company, 5600 Pike Road, Rockford, Ill. Air cylinder 142 is connected to a separation block 144 having cut-off blade 146 comprised of tungsten carbide. Cut-off blade 146 is positioned next to securement block 143 also made of tungsten carbide. Separation block 144 is positioned for vertical movement in the directions of arrow 149, and has two recesses 145 receiving springs 147 therein. The springs 147 abut against a subjacent assembly located below separation block 144, the subjacent assembly including pressure pad 150. Pressure pad 150 has two recess openings 156 receiving springs 158 therein, and a plurality of longitudinal transmittal slots 152 proportioned to receive terminals 84 of carrier web 80 after the terminals have been separated from the carrier web.

Separation block 144 is positioned slightly above pressure pad 150, and the two associated mechanisms utilize the concept of over-riding springs to effect the terminal separation or cutting movement. Separation block springs 147 have a lower spring rate and therefore less resistance to downward movement than do the pressure pad springs 158 which have a higher spring rate. Thus, when separation block 144 is moved downwardly, springs 147 offer less resistance than do the springs 158 so that the lower surface 148 of separation block 144 engages upper surface 153 of pressure pad 150 prior to the pressure pad 150 moving downwardly. Terminals 84 are separated from the carrier portion 82 by means of the separation block 144 moving downwardly perpendicularly to the terminals so that cut-off blade 146 separates and traps the terminals in the associated longitudinal transmittal slots 152, and then the separation block 144 and pressure pad 150 move downwardly together to position the transmittal slots 152 for terminal insertion. This downwardly stroke or movement is terminated by pad surface 155 engaging base surface 157 (FIGS. 8 and 9).

As shown in FIGS. 8, 9, and 10, located adjacent the pressure pad transmittal slots 152 are a plurality of transmittal barrels 162 in fixed barrel base 160. Transmittal barrels 162 correspond to the number of pressure pad slots 152 and are fixedly positioned for alignment with transmittal slots 152 so that separated terminals 84 can be received for transmission through the transmittal barrels.

Located exteriorly of transmittal slots 152 is a compressed air feed apparatus designated generally by reference numeral 200 (FIGS. 9 and 10). Compressed air feed apparatus 200 includes an air cylinder 202 connected by valve rod 204 to valve assembly 206. Valve assembly 206 contains valve 208 to which compressed air is fed by the compressed air line 209. The compressed air cylinder 202 is operated automatically to move valve rod 204 laterally away from valve assembly 206, thereby allowing valve 208 to move inwardly so that compressed air enters into compressed air passageway 205, as shown by the dotted line 203. The compressed air passes through the passageway 205 to the plurality of aligned pressure pad transmittal slots 152.

Across from exit openings 164 (FIGS. 3, 9, and 10) of transmittal barrels 162, is the substrate securement and lateral transmission assembly designated generally by reference numeral 170. Securement and lateral transmission assembly 170 includes a Tom Thumb ("DAV" series) air cylinder 172 connected by rod 171 to clamping block 174. Clamping block 174 comprises an assembly block located for lateral movement along the clamp base 175, with compressed spring 173 biasing end 182 of clamping block 174 upwardly against cam roller 176. Substrates 15 are located in trackway 20 adjacent assembly 170, the lead substrate 15 having been advanced along subjacent level 23 by plunger 72 of substrate advancement apparatus 70. Located beneath trackway 20 and directly adjacent the assembly 170, is a vacuum opening 166 (FIG. 5), which communicates with the subjacent level 23 of chute 21 to draw the lead substrate downwardly and slow its advance, thereby keeping it in abutting relationship with the plunger 72 so that the substrate may be accurately positioned along the chute 21 relative to the length of the trackway, the positioning being varied by adjusting the plunger stroke. It is the plunger stroke which precisely positions a lead substrate 15 along the trackway 20.

Assembly 170 operates automatically whereby upper clamping arm 177 moves downwardly to secure the endmost substrate 15 between upper clamping arm 177 and lower clamping arm 178. This occurs when air cylinder 172 is activated and moves the rod 171 laterally, i.e. toward the right in the direction of arrow 169 to displace clamping block 174. Spring 173 biases end 182 of clamping block 174 upwardly against stationary cam roller 176 which rolls along cam ramp 179 and results in the downward movement of the clamping arm 177. Substrate 15 is secured between the clamping arms 177, 178 and moved laterally a predetermined distance to be positioned adjacent exit openings 164 of transmittal barrels 162, and thus each substrate cavity 16 is accurately positioned in alignment with its associated transmittal barrel 162.

Terminal insertion assembly 120 is adjustable for insuring that terminals 84 are accurately received in the pressure pad transmittal slots 152. Adjustment bolts 122 (see FIGS. 3 and 10) may be loosened so that all of the assemblies adjacent the transmittal barrels, barrel base, separation apparatus, and pressure pad may be moved. In other words, the web securement apparatus 96, web advance apparatus 100, web track 107, web hold down apparatus 130, and the subjacent supports may all be moved relative to the barrel base 160. Barrel base 160 and the separation apparatus 140 do not move relative to the movement of these other components. Adjusting rod 123 (FIG. 9) is connected to the subjacent base 240 and can displace base 240, which is positioned around barrel base 160, which moves laterally the carrier web 80 relative to the cut-off blade 146, and thereby adjust the lengths of the terminals being separated by a lead terminal insertion assembly 120. Barrel base 160 serves as a guide for the movement of base 240 and the components and apparatuses supported thereon, relative to the barrel base 160 and the separation apparatus 140.

Figure 11:
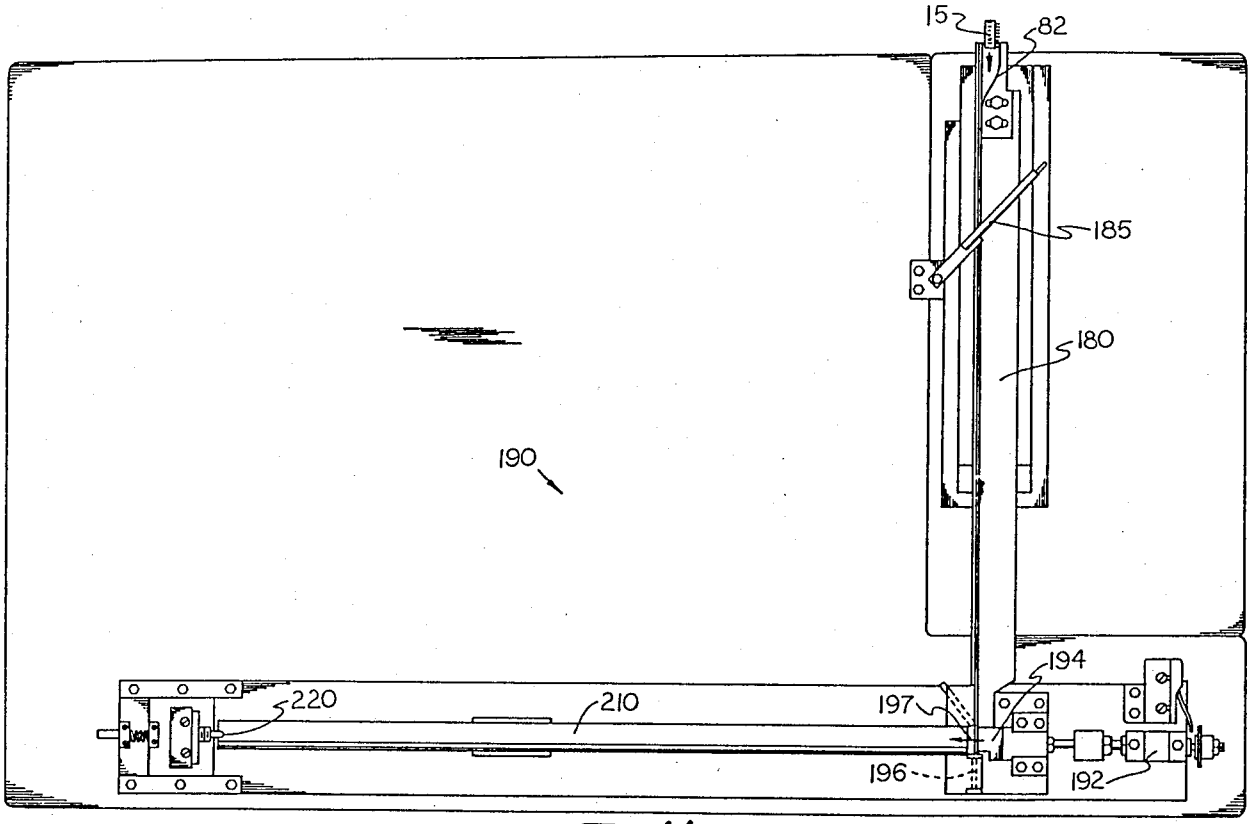
FIG. 11 is a top view of the ejection trackway and magazine loading apparatus.

Referring to FIGS. 3, 10, and 11, an ejection trackway 180 receives substrates 15 with terminals 84 inserted therein, each such substrate being pushed out, in seriatim, from insertion position into ejection trackway 180 by the advancement of the next substrate into insertion position, as effected by the plunger 72 of substrate advance apparatus 70. The assembled substrates move by gravity down ejection trackway 180 which has a twist 182 for positioning the substrates in a vertical orientation, and then advance along the ejection trackway by means of vibration imparted to the trackway by vibratory mechanism (not shown).

Ejection trackway 180 advances the vertically oriented substrates 15 into the magazine loading apparatus designated generally be reference numeral 190 (see FIG. 11). Along ejection trackway 180 is photoelectric sensor 185 positioned to detect a backup of substrates from magazine loading apparatus 190. If photoelectric sensor 185 is tripped by a backup of assembled substrates, the entire terminal insertion apparatus 10 will automatically shut down until the magazine loading apparatus can load the backlog of substrates and more assembled substrates can advance along ejection trackway 180.

The magazine loading apparatus 190 includes a Tom Thumb air cylinder 192, ("DAV" series), operatively connected to push block 194. Magazine loading apparatus 190 supports a magazine 210 positioned in the assembly, and located at the other end of magazine 210 is microswitch 220. Loading apparatus 190 receives the serially aligned and vertically oriented substrates 15 advanced down ejection trackway 180 by means of the vibratory mechanism, the lead substrate vibrating into loading position and blocking air hole 196 when it reaches the end of the ejection trackway. The blocking of the air hole 196 operatively activates cylinder 192 which moves push block 194 laterally relative to trackway 180 in the direction of arrow 197 in FIG. 11, and pushes the endmost substrate 15 into magazine 210. Magazine 210 holds approximately 250 assembled substrates, and when the first loaded substrate advances to the opposite end of the magazine, microswitch 220 is contacted and the magazine loading assembly shuts down until an empty magazine 210 is mounted for loading.

OPERATION

The automatic terminal insertion apparatus 10 is operated automatically by timing devices well known in the art, such as electrical timing cams powered by an electrical motor. One such device is called a Syncrocam made by Gilman Engineering & Manufacturing Company, Janesville, Wis., 53545. Likewise, a microprocessor may be utilized to control and coordinate the various functions of the subassemblies of insertion apparatus 10.

These timing devices coordinate the operation of the individual subassemblies and apparatuses, so that the substrates 15 are advanced automatically and moved into insertion position with a high degree of accuracy and timing, and simultaneously carrier web 80 is advanced accurately into terminal insertion assembly 120 and positively and accurately positioned for the separation of a predetermined number of terminals 84. The substrates 15 are advanced along trackway 20 by the substrate advance apparatus 70, as shown in FIG. 5. Advance apparatus 70 positions the endmost or lead substrate for securement and lateral displacement by transmission assembly 170. The substrate is positioned adjacent exit openings 164 at the end of the transmittal barrels 162, whereby the substrate apertures 16 are accurately positioned for terminal insertion. Web 80 is automatically advanced be web advance apparatus 100 (FIG. 7) that feeds the web 80 into the web hold down apparatus 130. Web hold down apparatus 130 inserts locator pins 136 (FIG. 8) through carrier web apertures 83 and into pin receptors 138 to secure the web 80 for the separation of terminals 84. Separation apparatus 140 (FIG. 9) is activated and separation block 144 moves downwardly so that blade 146 separates the terminals 84 from the web portion 82 and they fall into the pressure pad transmittal slots 152. Surface 148 of separation block 144 presses against the upper surface 153 of pressure pad 150, to form an enclosure for the separated terminals 84 disposed within the respective transmittal slots 152. Separation block 144 and pressure pad 152 move downwardly together until the transmittal slots align with their associated transmittal barrels 162.

Compressed air feed apparatus 200 is activated to move valve rod 204 and allow displacement of valve 208, thereby allowing compressed air to enter into air passageway 205 communicating with the transmittal slots 152. Compressed air enters the transmittal slots and propels the terminals 84 through the transmittal slots and aligned transmittal barrels 162. The terminals travel through slots 152 and barrels 162 at speeds estimated as high as several hundred miles per hour. The cut ends of the terminals enter into the respective cavities in the aligned substrate 15, with such velocity and force that the cut ends bite into the ceramic substrate and anchor the terminals in the substrate. The anchored terminals have a maximum pull out force as great as twenty pounds per terminal.

The advancement of the carrier web into terminal insertion assembly 120, and the subsequent separation and insertion of the terminals into substrate cavities 16, is all accomplished without any gripping or clamping of the terminals 84. Thus, the terminals may be plated with compositions such as gold, silver, etc. and be inserted into the cavities in the ceramic substrate without any scratching, marring, swaging, or deformation. Likewise, the exterior end of each terminal, which may be plated or unplated, is not altered from its preformed shape and cut marks are not present.

It should be understood that the automatic terminal insertion apparatus 10 may be utilized for the insertion of round terminals as well as flat terminals. Terminals that are generally cylindrical in shape but the exterior end of which is round (see terminals 19 in FIG. 14), may be inserted by this apparatus and terminal insertion technique, thereby providing a cylindrical terminal having a round end. Round terminal ends render the resistor module suitable for machine insertion into pluggable components whereby the ends of the round terminal (plated or unplated) can be inserted into metal connectors without scratching or deformation of the metallic connector or socket.

After the terminals have been anchored in the cavities 16, the substrate securement and lateral transmission assembly 170 retracts laterally toward the trackway 20 as shown in FIG. 9, to reposition the substrate 15 in chute 21. End 182 of clamping block 174 is biased downwardly by cam roller 176, which raises arm 177 to release the substrate 15 from the grip of arms 177 and 178. Substrate advance apparatus 70 and escapement mechanism 220 cycle so that the next substrate is released, drops downwardly into subjacent level 23, and is pushed forward to move the substrate with anchored terminals along ejection trackway 180. Assembled substrates move by gravity down trackway 180 toward magazine loading apparatus 190. The next substrate is then in position for securement by clamps 177, 178 and lateral displacement into insertion position for receiving a plurality of terminals propelled by compressed air through slots 152 and barrels 162.

Figure 12:
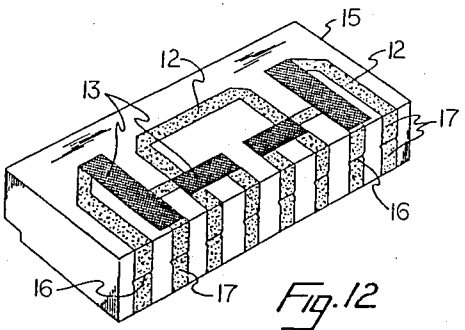
FIG. 12 is an isometric view of a fired alumina substrate without terminals inserted therein.
Figure 13:
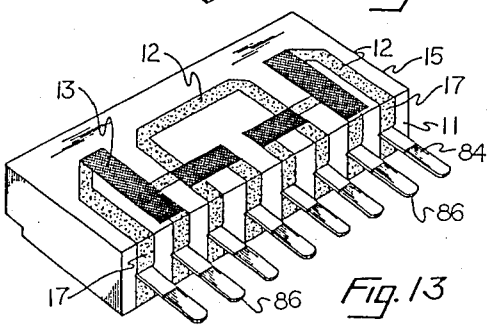
FIG. 13 is an isometric view of the alumina substrate of FIG. 12 after insertion of the terminals.

A substrate utilized in this operation is illustrated in FIGS. 12 and 13. FIG. 12 is an isometric view of the fired alumina substrate 15 prior to insertion of terminals. Conductive paths 12 and resistors 13 are screen printed upon the substrate and fired, conductive paths 12 including conductive pads or notches 17 located on the end surface 11. The cavities 16 are shaped differently from the type of terminal to be inserted therein. It should be understood that the present invention produces resistor network modules having either flat or round terminals anchored in cavities 16. The anchored terminals can then be coated by wave soldering, as is known in prior art techniques, to produce a resistor network with terminals having exterior portions symmetrically formed and without any cut marks or irregularities.

The terminals may be plated prior to insertion into the substrate cavities, thus producing a resistor module with plated terminals anchored therein, the terminals connected to the pads 17 by the selective solder deposition and reflow process and having a plated portion that has not been scratched, swaged, or deformed in any manner. The module with plated terminals is suitable for automatic insertion onto a PC board having metallic conductors or sockets, plated or unplated, for receiving the plated terminals. Such a substrate is illustrated in FIG. 13 wherein there is illustrated a substrate 15 having a plurality of plated terminals 84 anchored and secured therein. The cut ends of the terminals 84 have been anchored in the respective cavities 16. The selective solder deposition and reflow process adds additional mechanical securement of the terminals 84, and also enhances the electrical conductivity between the terminals and conductive pads 17. Plated portions 86 of terminals 84 are not scratched, damaged, swaged, or deformed in any manner and are suitable for insertion into plated metallic connectors. The substrate 15 may be coated with epoxy and identification marking added.

Resistor network modules manufactured in accordance with the apparatus and method of the present invention, have an increased wear life and greater reliability because of the lack of deformed terminal ends being inserted into a connector, which could deform or scratch the metallic connector, and the retention of the integrity of the terminal plating. The contact resistance is lowered by the plating which also precludes corrosion, and the plating is not scratched or deformed prior to or during insertion of the terminals into the substrate.

Figure 14:
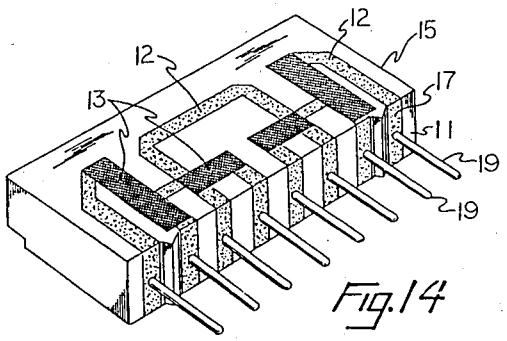
FIG. 14 is an isometric view of a substrate having cylindrical terminals with round ends; and, FIG. 15 is an isometric view of another substrate embodiment suitable for having terminals inserted and anchored therein by the apparatus and method of the present invention.

FIG. 14 is an illustration of round terminals 19 anchored by the techniques and apparatus of the present invention, the rounded terminal ends suitable for insertion into metallic sockets without deformation or damage to the sockets. After insertion into the substrate, cylindrical terminals 19 may be wave soldered to provide a protective corrosion resistant coating. In the alternative, terminals 19 may be plated prior to separation from the carrier web and insertion into cavities 16 of substrate 15.

Figure 15:
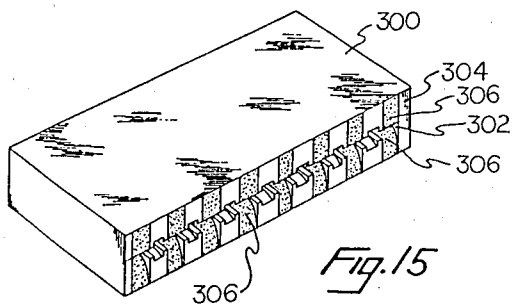

FIG. 15 illustrates another substrate embodiment suitable for receiving terminals inserted and anchored therein. Substrate 300 has a longitudinal recess 302 in edge surface 304, the recess having spaced-apart pairs of conductive coated abutments 306 located therein. Separated terminals may be propelled and anchored in the narrow areas located between the pairs of conductive coated abutments 306, and then wave soldered to complete the electrical connections with the conductive. Also, selectively plated terminals may be inserted and then connected to conductive coated abutments by the selective solder deposition and reflow process.

CONCLUSION

Although the present invention has been illustrated and described in connection with an example embodiment, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

We claim:

1. A process for the automatic insertion of terminals into a substrate having a means for receiving terminals, comprising the steps of:

(a) orienting and supplying a plurality of substrates to a guide means positioned upon a base;

(b) conveying said substrate along said guide means for further advancement by substrate advancement means, positioned adjacent to said guide means;

(c) supplying terminal carrier means with terminals to a terminal insertion apparatus positioned upon said base;

(d) advancing a substrate into alignment with said terminal insertion apparatus from said guide means;

(e) securing said terminal carrier means against movement in preparation for separating a plurality of said terminals from said carrier means;

(f) separating a predetermined number of terminals from said carrier means with a separating means;

(g) disposing said separated terminals upon a plurality of longitudinal transmittal slots on said terminal insertion apparatus, with the separated end of the terminals disposed towards said aligned substrate;

(h) enclosing the separated terminals between said transmittal slots and a pressure pad operative with said separation means to form a plurality of transmittal barrels with terminals enclosed therein;

(i) introducing a compressed medium into said transmittal barrels to forceably propel said separated terminals through said barrels towards said aligned substrate to forceably insert and anchor the separated end of the terminals into the means for receiving terminals in said substrate; and (j) withdrawing said substrate having terminals inserted therein from said terminal insertion apparatus to an ejection trackway for subsequent removal from said automatic insertion apparatus.

2. The process of claim 1, wherein step (h) further comprises:

aligning the plurality of transmittal barrels formed by enclosing the separated terminals between said aligned transmittal slots and a pressure pad, with a plurality of aligned transmittal barrels extending between said transmittal slots and said aligned substrate, in a manner to guide the separated terminals from the plurality of transmittal slots forming transmittal barrels through the aligned transmittal barrels to forceably insert the separated end of the terminals into the aligned means for receiving terminals in said substrate, upon introduction of the compressed propelling medium into the transmission barrels.

3. The process in accordance with claim 1, further comprising the step of periodically advancing said terminal carrier means by gripping said web and advancing it into the terminal insertion apparatus in preparation for separation of a plurality of terminals from the carrier means.

4. The process in accordance with claim 1, including the step of testing a circuit means on each of said substrates and ejecting substrates with defective circuit means from said guide means.

5. The process in accordance with claim 1, including the step of adjusting the position of said terminal carrier means in relation to said means for separating a number of said terminals from said terminal carrier in order to vary the length of the separated terminals.

6. The process in accordance with claim 1, further comprising the step of supplying the compressed medium to a valve means for periodic release of compressed medium into said transmittal barrels in said terminal insertion apparatus, subsequent to disposing the separated terminals into said transmittal barrels.

7. The process in accordance with claim 1, wherein step (d) includes moving said advanced substrate laterally relative to said guideway to position the terminal receiving means in alignment with associated passageways of said terminal insertion apparatus.

8. The process in accordance with claim 1, further comprising the step of automatically detecting that a sufficient number of substrates are being supplied to said terminal insertion apparatus to continue operation.

9. The process in accordance with claim 1, wherein said terminals are inserted and anchored in said terminal receiving means without any deformation or damage to the noninserted end of said terminals.

10. The process in accordance to claim 1, wherein said terminals are plated terminals and the separated end of the terminal is anchored in the terminal receiving means of the substrates without damage to said terminal plating extending from said substrate.

11. A process for the automatic insertion of terminals into a substrate having a means for receiving terminals, comprising the steps of:

(a) supplying terminal carrier means with terminals to a means for inserting said terminals, said terminal inserting means including means for separating terminals from said terminal carrier means;

(b) periodically orienting and supplying each of a plurality of substrates to the means for inserting terminals;

(c) moving said separating means in a direction perpendicular to the direction of supply of said terminal carrier means whereby said separating means separates a predetermined plurality of terminals from said terminal carrier means and disposes said separated terminals into said means for inserting terminals for transmittal to said substrate terminal receiving means; and (d) introducing a compressed medium into said terminal inserting means to propel the separated end of the terminals along a direction perpendicular to the direction of supply of said terminal carrier means whereby said separated terminals are propelled into said substrate terminal receiving means, to effect insertion therein.

12. The process in accordance with claim 11, wherein the terminals of said carrier means with terminals, each have a terminal end extending from said carrier means, and at least a portion of each said terminal is plated prior to supplying the terminal carrier means to the means for inserting said terminals.

13. The process in accordance with claim 11, further comprising the step of orienting said substrates upon a guide means by means of an automatic vibratory supply means.

14. The process in accordance with claim 11, further comprising the step of advancing a substrate into terminal insertion position by moving said substrate in a direction parallel to the direction of movement of said terminal carrier means and then moving said substrate perpendicularly relative to the direction of movement of said terminal carrier means.

15. The process in accordance with claim 11, further comprising the step of disposing means for holding said separated terminals subjacent to said terminal carrier means whereby said holding means receives said separated terminals and mates with said terminal separating means to capture each of said separated terminals for transmittal to said terminal receiving means.

16. The process in accordance with claim 11, further comprising the step of automatically determining the position of said terminal carrier means relative to said terminal inserting means in order to effect a precise positioning of said terminals for separation from said terminal carrier means.

17. The process in accordance with claim 11, further comprising the step of automatically supplying the terminal carrier means to said terminal inserting means and sensing when a splice of said terminal carrier means is about to enter said terminal inserting means.

18. The process in accordance with claim 11, further comprising the steps of supplying said substrates along trackway means and testing circuit means disposed on each of said substrates.

19. The process in accordance with claim 18, further comprising the step of automatically testing and automatically ejecting from said trackway substrates having defective circuit means.

20. The process in accordance with claim 11, further comprising the step of advancing assembled substrates comprising substrates with terminals inserted in the respective terminal receiving means, along a trackway and automatically loading said assembled substrates.

21. The process in accordance with claim 11, further comprising the step of supplying said substrates along a direction parallel to the direction of movement of said terminal carrier means, wherein the first-in-line substrate in said terminal inserting means is positioned upon means for pushing said substrate, retraction of said pushing means causes said first-in-line substrate to drop downwardly, and the extension of said pushing means moves said first-in-line substrate along said parallel direction.

22. The process in accordance with claim 21, further comprising the step of moving said first-in-line substrate laterally to said direction of supplying said substrate, in order to accurately position the terminal receiving means.

23. The process in accordance with claim 21, wherein said first-in-line substrate is pushed by means for pushing substrates into a means for effecting lateral movement of said substrate, said means for effecting lateral movement having a substrate gripping means and a lateral movement means disposed thereon; wherein the first-in -line substrate is moved perpendicularly relative to the direction of supplying said substrates and the substrate means for receiving terminals is positioned and aligned for subsequent insertion of said separated terminals.

24. The process in accordance with claim 11, further comprising the step of adjusting the position of said terminal carrier means relative to said terminal separating means in order to vary the length of said separated terminals.

25. The process in accordance with claim 11, further comprising the steps of periodically advancing said terminal carrier means and securing said terminal carrier means in between each advancement step by engaging said terminal carrier means with means for securing said terminal carrier means.

26. The process in accordance with claim 25, wherein the step of securing said terminal carrier means includes the insertion of projection post means through associated apertures in said terminal carrier means.

27. The process in accordance with claim 11, including the step of cutting said terminal carrier means into predetermined lengths after said terminals have been separated therefrom.

28. The process in accordance with claim 11, further comprising the step of slowing the movement of a substrate being supplied, by effecting a vacuum with a surface of said substrate.

29. The process in accordance with claim 11, wherein said terminal carrier means with terminals comprise a plurality of selectively plated terminals disposed in spaced relation upon said terminal carrier means, and disposing the terminal ends separated by the separating means from said terminal carrier means into said terminal receiving means with the separated terminal end aligned towards the oriented substrate in preparation for insertion of the separated terminal end into the substrate means for receiving terminals.

30. The process in accordance with claim 11, wherein said terminals comprise cylindrically shaped terminals.

31. The process in accordance with claim 11, wherein the terminal carrier means with terminals comprise a plurality of rectangular shaped terminals disposed in spaced relation upon said terminal carrier means and disposed for separation of the terminal end from said terminal carrier means for subsequent insertion into said terminal receiving means.

32. The process in accordance with claim 11, wherein said substrate terminal receiving means comprises a plurality of apertures, each aperture disposed within said substrate for receiving a non-complimentary shaped separated terminal propelled by said compressed medium through said terminal inserting means to effect insertion therein.

33. A terminal insertion apparatus for the automatic insertion of terminals into a substrate having terminal receiving means, which comprises:

(a) guideway means for receiving and conveying a plurality of substrates to the substrate side of said terminal insertion apparatus;

(b) means for supplying a continuous terminal carrier with terminals disposed thereon to the terminal side of said terminal insertion apparatus;

(c) means for periodically advancing said terminal carrier toward the terminal side of said terminal insertion apparatus;

(d) means for periodically advancing said substrates from said guideway means into alignment with a plurality of transmittal barrels located traversely between said substrate side and said terminal side in said terminal insertion apparatus, said means for advancing substrates operatively connected to said means for advancing said terminal carrier to coordinate movement therebetween;

(e) means for periodically securing said terminal carrier with terminals disposed thereon in preparation for separation of a predetermined number of terminals therefrom;

(f) means for periodically separating said predetermined number of terminals from said secured terminal carrier to dispose said separated terminals upon a plurality of longitudinal transmittal slots disposed on said terminal side of said transmittal barrels on said terminal insertion apparatus, with said separated end of said separated terminals positioned towards said aligned substrate, said means for separating said terminals moves perpendicularly relative to the movement of the terminal carrier to periodically separate said terminals;

(g) means to cover said disposed terminals in said transmittal slots, operative with said separation means;

(h) means to align said covered transmittal slots with the plurality of transmission barrels in said terminal insertion apparatus;

(i) means for periodically supplying a compressed medium to said covered transmittal slots, whereby the separated terminals are forceably propelled by the compressed medium through the transmittal barrels to insert and anchor the separated end of the terminal into the aligned terminal receiving means of the substrate; and (j) means for removal of said substrate with terminals inserted from said terminal insertion apparatus.

34. The apparatus in accordance with claim 33, wherein the means for periodically advancing substrates includes clamping means for securing said substrate and pushing means for moving said substrate laterally towards the substrate side of the transmittal barrels relative to said guideway means to align said substrate terminal receiving means in relation to said transmittal barrels for subsequent reception of said separated terminals therein.

35. The apparatus in accordance with claim 33, further comprising means for adjusting the position of said terminal carrier in relation to said means for separating a number of said terminals from said secured terminal carrier in order to vary the length of the separated terminals disposed upon the transmittal slots.

36. A process for the pneumatic insertion of a plurality of terminals into a plurality of terminal receiving means within an aligned substrate, comprising:

(a) progressively advancing a terminal carrier means having regularly spaced terminals projecting from an edge thereof;

(b) progressively separating a predetermined quantity of the terminals from the terminal carrier means;

(c) positioning each separated terminal within a relatively fluid tight passageway, with the separated end of each separated terminal positioned towards the aligned substrate; and (d) pneumatically propelling each said separated terminal through each said passageway at high linear speed sufficient to penetrate and anchor the separated end of each separated terminal within one of said terminal receiving means of said aligned substrate.

37. The process of claim 36, wherein each regularly spaced terminal on the terminal carrier means has a joined end located at the terminal carrier means and a pre-formed unjoined end extending in spaced relation from said joined end, so that upon separation of each terminal from said terminal carrier means there is a single severed portion constituting the entry end of the terminal as it is forceably propelled to penetrate into the aligned substrate terminal receiving means to effect terminal insertion therein.

38. The process of claim 36, wherein the terminal receiving means of the aligned substrate is an aperture sized to provide an interfering fit with the separated end of the terminal as said terminal impacts and penetrates the aperture of said terminal receiving means at high linear speed to forceably receive and anchor said terminal within said aperture.

* * * * *